United States Patent [19]

Hayton et al.

[11] Patent Number: 4,945,582

[45] Date of Patent: Aug. 7, 1990

[54] PATIENT TRANSPORT APPARATUS INCLUDING INDEPENDENTLY OR SIMULTANEOUSLY OPERABLE LEG AND BACKREST PORTIONS

[75] Inventors: Eugene Hayton, Medina; Raymond A. Failor, Seville; Dan Singleton, Wadsworth, all of Ohio

[73] Assignee: Hausted, Inc., Medina, Ohio

[21] Appl. No.: 349,696

[22] Filed: May 10, 1989

Related U.S. Application Data

[63] Continuation-in-part of Ser. No. 166,675, Mar. 11, 1988, Pat. No. 4,858,260.

[51] Int. Cl.[5] ..... A61G 7/06

[52] U.S. Cl. ..... 5/67; 5/68; 5/73; 297/90; 297/433

[58] Field of Search ..... 5/67, 68, 73, 80; 297/90, 433

[56] References Cited

U.S. PATENT DOCUMENTS

| | | | |
|---|---|---|---|
| 1,703,237 | 2/1929 | Holtkamp | 5/68 X |
| 2,658,210 | 11/1953 | Travis . | |
| 2,819,475 | 1/1958 | Ericsson . | |
| 3,262,133 | 7/1966 | Beitzel | 5/67 X |
| 3,284,126 | 11/1966 | Piazza | 5/67 X |
| 3,317,931 | 5/1967 | Benoit et al. | 5/68 |
| 3,345,652 | 10/1967 | Hiraga | 5/67 X |
| 3,398,411 | 8/1968 | Douglass | 5/67 |
| 4,097,940 | 7/1978 | Tekulve et al. | 5/68 X |
| 4,751,755 | 6/1988 | Carey, Jr. et al. . | |
| 4,821,351 | 4/1989 | Bergenwall | 5/67 |

FOREIGN PATENT DOCUMENTS

| | | | |
|---|---|---|---|
| 144986 | 10/1903 | Fed. Rep. of Germany | 5/67 |
| 2525596 | 12/1976 | Fed. Rep. of Germany | 5/67 |
| 54737 | 12/1934 | Norway | 5/67 |

OTHER PUBLICATIONS

Stretchair Patient Transfer System—TM of MLA Mobilizer.
The All-In-One Medi-Chair—by Trans-Aid Corp.
Trade West brochure—by Hoxan.
Ortho-Biotic Seating—by Lumex, Inc.
Inval-Aid Chair—by Hausted.

*Primary Examiner*—Gary L. Smith
*Assistant Examiner*—Michael J. Milano
*Attorney, Agent, or Firm*—Hoffmann & Baron

[57] ABSTRACT

A multi-purpose chair/stretcher assembly is disclosed which includes seat, backrest and leg supporting assemblies, the backrest and leg supporting assemblies both being pivotably mounted to the seat assembly. A pair of telescoping linkage assemblies connect the backrest and leg supporting assemblies so that the pivotal movement of one with respect to the other causes both to rotate in the same direction if restricted from telescoping. If this linkage assembly is allowed to telescope, the backrest assembly may be moved independently of the leg supporting assembly. A second linkage assembly connects the leg supporting assembly with the seat assembly. This second linkage assembly, while extendable and contractable, may be locked in a rigid configuration so that the leg supporting assembly may be held in a fixed position with respect to the seat assembly.

21 Claims, 4 Drawing Sheets

PATIENT TRANSPORT APPARATUS INCLUDING INDEPENDENTLY OR SIMULTANEOUSLY OPERABLE LEG AND BACKREST PORTIONS

CROSS REFERENCE TO RELATED APPLICATION

This application is a continuation-in-part of U.S. application Ser. No. 166,675 filed Mar. 11, 1988, now U.S. pat. No. 4,858,260.

BACKGROUND OF THE INVENTION

1. Field of the Invention

The field of the invention relates to patient transport apparatus having adjustable leg and backrest portions.

2. Brief Description of the Prior Art

Multi-purpose chair/stretcher assemblies are well known to the art. Such assemblies provide great versatility in that they can be used as wheelchairs, lounge chairs and stretchers. A patient can be moved quickly and safely from sitting to supine positions and vice versa. A number of such chairs include linkage assemblies which allow the leg and backrest portions to be moved simultaneously. While undergoing such movement, the leg and backrest portions are maintained substantially parallel to each other until they reach the supine position, where they are coplanar.

It is often desirable to orient the leg and backrest portions at various positions which are not necessarily parallel to each other. Some hospital beds and other such structures allow the leg and backrest portions to be positioned independently so that virtually any position is obtainable, Most of these structures operate hydraulically and do not depend upon the operation of a linkage assembly to position the seat and backrest portions in a predetermined relation to each other.

SUMMARY OF THE INVENTION

It is an object of the invention to provide a patient transport apparatus including leg and backrest portions which may be operated simultaneously or independently.

It is another object of the invention to provide a patient transport apparatus in which the leg and backrest portions can be oriented in a number of positions with respect to each other.

In accordance with these and other objects of the invention, a multi-purpose patient support apparatus is provided which includes seat, backrest and leg supporting assemblies, the backrest and leg supporting assemblies both being pivotably mounted to the seat assembly, means for connecting the backrest and leg supporting assemblies so that the pivotal movement of one with respect to the seat assembly causes the other to rotate in the same direction, and means for deactuating the connecting means so that the leg supporting assembly and backrest assembly can be rotated independently of each other. Means are provided for locking the leg support and backrest assemblies in desired positions regardless of their angular orientations.

In accordance with a preferred embodiment of the invention, first linkage means connect the backrest assembly and the leg supporting assembly, the first linkage means being extensible and contractible. First locking means are provided for locking the first linkage means so that they are unable to extend or contract. Rotation of the backrest assembly with respect to the seat assembly causes corresponding rotation of the leg supporting assembly when the first linkage means is so locked. Second linkage means are provided for connecting the seat assembly and the leg supporting assembly, the second linkage means also being extensible and contractible. Second locking means are provided for preventing such extension and contraction of the second linkage means when in the locked position. When the backrest assembly and leg supporting assembly are to be moved simultaneously, the first linkage means are locked while the second are unlocked. To allow independent operation thereof, the first linkage means remain unlocked.

DETAILED DESCRIPTION OF THE INVENTION

Figure 1:
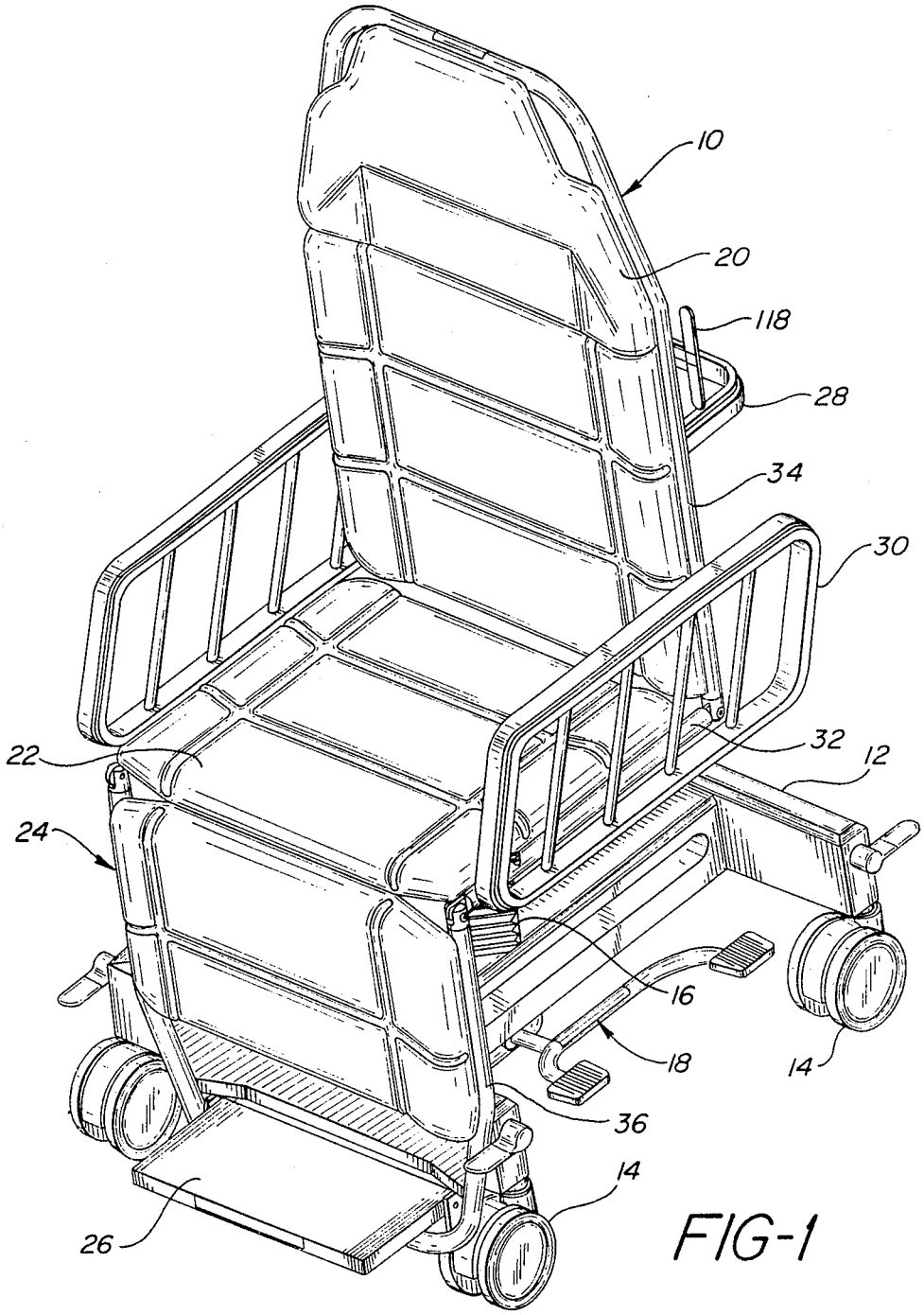
FIG. 1 is an isometric view of a patient transport apparatus in accordance with the invention.

A patient transport apparatus 10 as shown in FIG. 1 is provided. The apparatus includes a base 12 supported by wheels 14, a column 16 mounted to the base, foot pedals 18 for controlling hydraulic height adjustment of the column, and a chair/stretcher assembly mounted to the column.

The chair/stretcher assembly includes a backrest assembly 20, a seat assembly 22 and a leg supporting assembly 24. Padded cushions are mounted to the chair/stretcher assembly to provided patient comfort.

A footrest 26 is pivotably mounted to the leg supporting assembly. A U-shaped frame 28 is pivotably mounted to the backrest assembly 20 and is used as a push bar when transporting a patient. Guard rails 30 are pivotably mounted to the seat assembly 22. The guard rails are discussed in considerable detail in U.S. application Ser. No. 166,675 filed Mar. 11, 1988, now U.S. Pat. No. 4,858,260, which is incorporated by reference herein.

Figure 2:
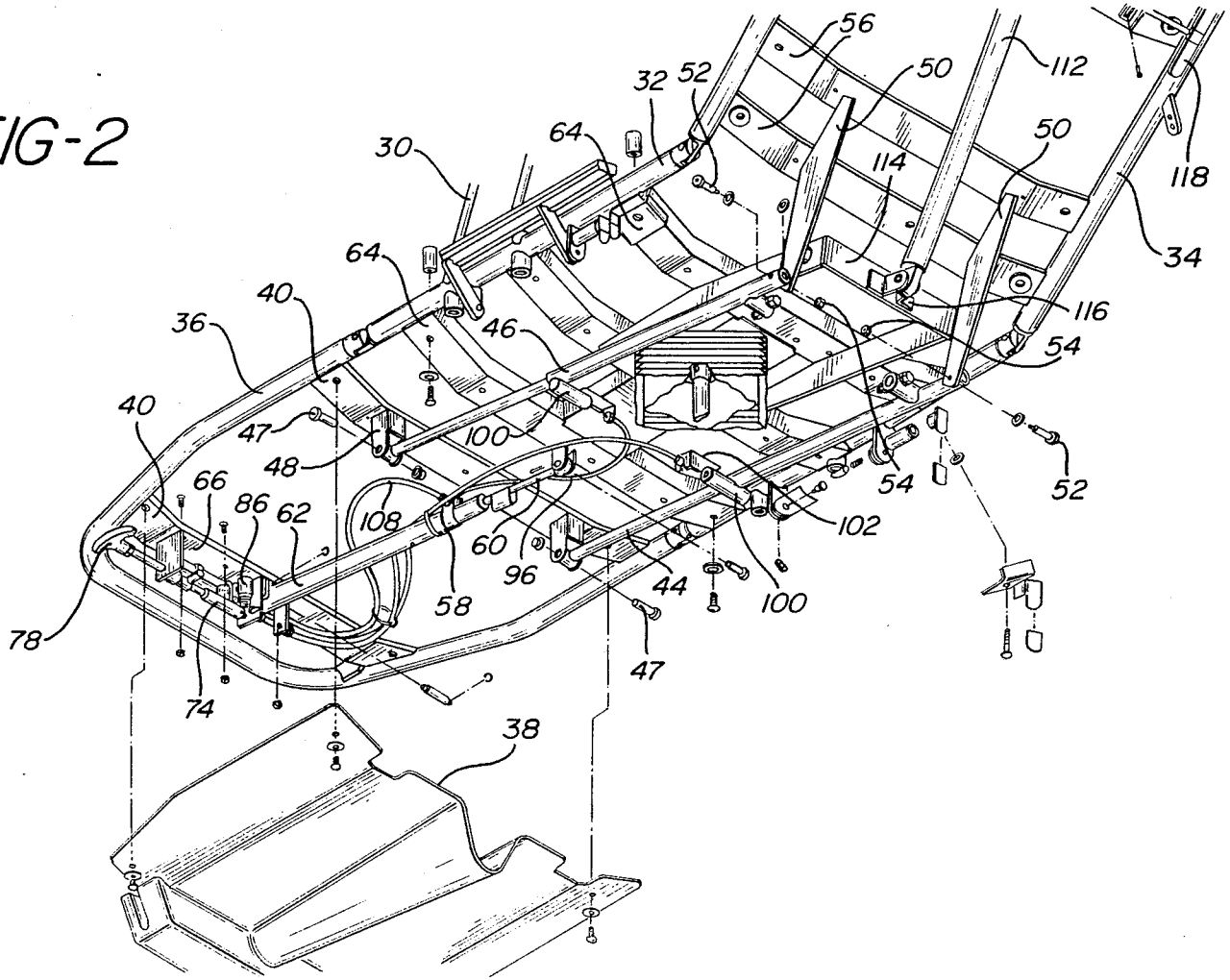
FIG. 2 is an isometric view of the seat, backrest and leg supporting assemblies for the apparatus shown in FIG. 1.

Referring to FIG. 2, the apparatus 10 includes a seat frame 32, a backrest frame 34 pivotably mounted to one end of the seat frame, and a leg supporting frame 36 pivotably mounted to the opposite end of the seat frame. A cover 38 is mounted to a pair of rails 40 extending laterally between the sides of the leg supporting frame 36.

A first linkage assembly 42 is pivotably connected between the backrest assembly 20 and the leg supporting assembly 24. The first linkage assembly 42 includes a pair of plunger rods 44 positioned, respectively, within a pair of cylindrical tubes 46. Each plunger rod 44 is pivotably connected by a clevis pin 47 to one of a pair of mounting brackets 48 which are secured to the upper of the two lateral rails 40 extending across the leg supporting frame 36. The tubes 46 are respectively connected at one end to a pair of projections 50 by shoulder bolts 52 and lock nuts 54. Each projection is secured to a pair of laterally extending rails 56 which are secured to the backrest frame 34. The plunger rods 44 are preferably lubricated to facilitate their sliding within the respective tubes 46.

A second linkage assembly 58 is pivotably connected between the seat assembly 22 and the leg supporting assembly 24. The second linkage assembly includes a plunger rod assembly 60 mounted partially within a cylindrical casing 62. The rod portion of the assembly may be locked in any of a number of positions as will be explained hereafter. The plunger rod assembly 60 is a commercially available extensible and contractible device which locks or unlocks upon movement of an actuating lever thereon. One such device is disclosed in U.S. Pat. No. 3,874,480. The plunger rod assembly 60 is pivotably connected to a rail 64 which extends laterally across the seat frame 32. The casing 62 is pivotably mounted to a bracket assembly 66 secured to the lower of the two rails 40 extending across the leg supporting frame 36.

Figure 3:
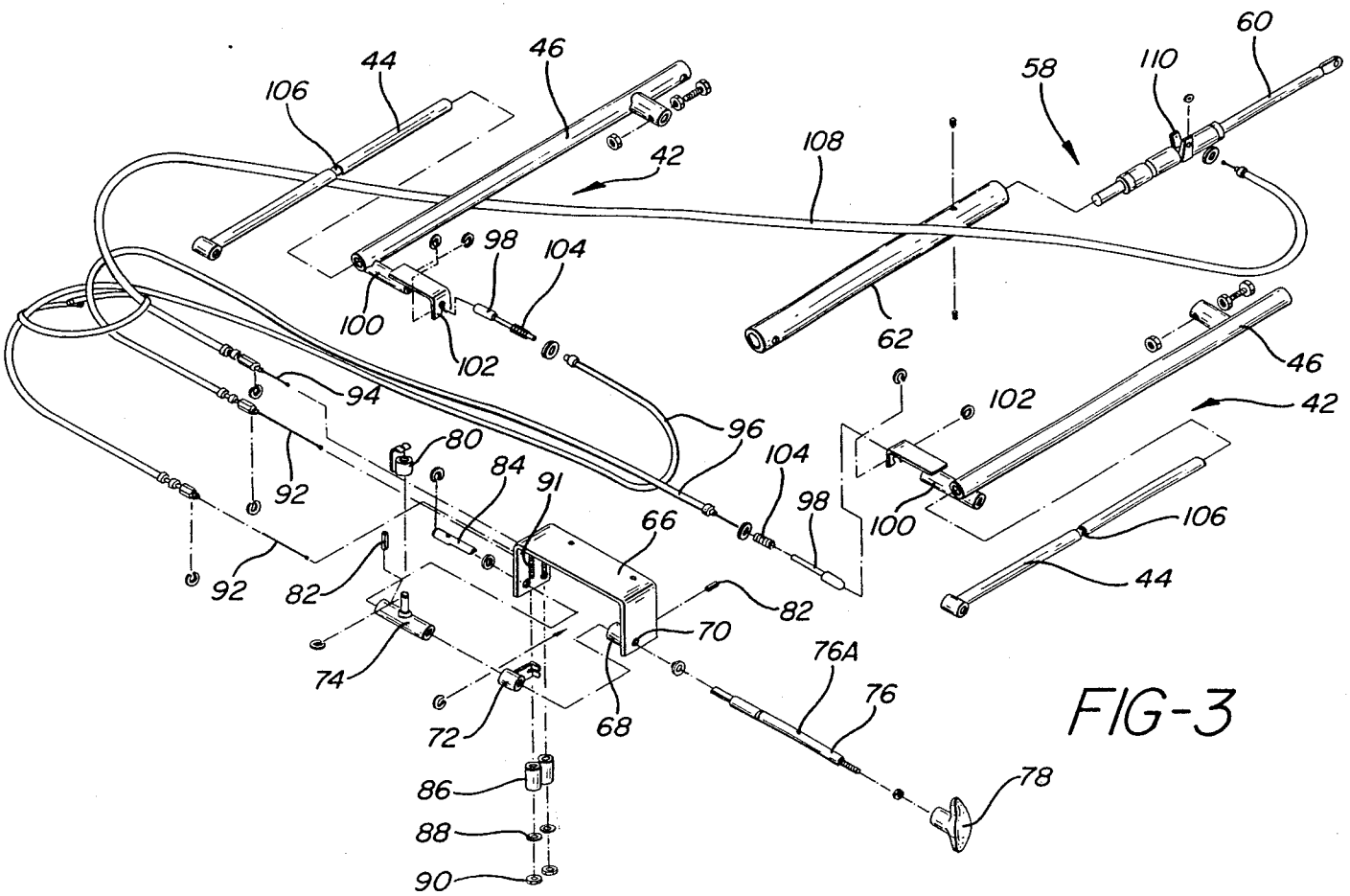
FIG. 3 is an exploded, isometric view of the linkage assemblies shown within FIG. 2.
Figure 4:
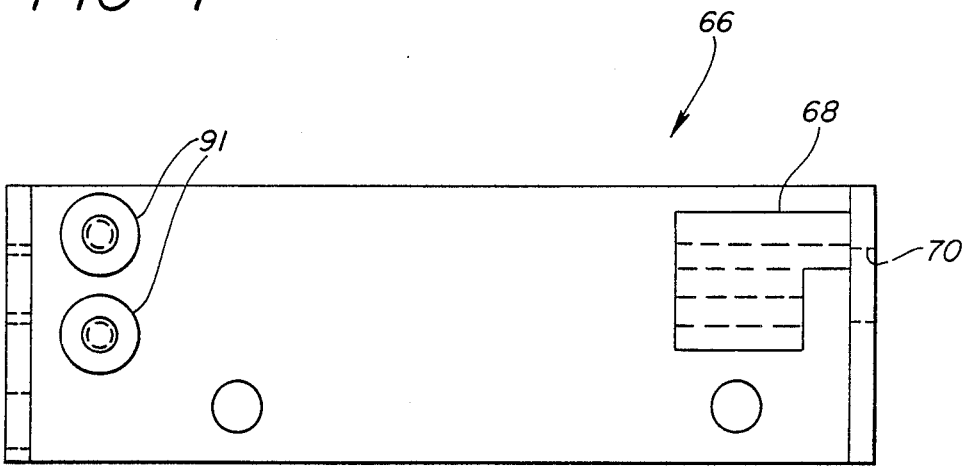
FIG. 4 is an enlarged bottom plan view of a bracket assembly shown in FIGS. 2 and 3.

Referring to FIGS. 2 and 3, the bracket 66 include a top and two opposing sides. A slotted, cylindrical guide 68 extends inwardly from one side of the bracket and is in alignment with an opening 70 therein. A pull tube assembly 72 is mounted adjacent to the cylindrical projection 68 and a control pivot assembly 74 is positioned adjacent to the pull tube assembly 72. Each such assembly 72, 74 is supported by a control shaft 76 which extends through the bracket 66. A handle 78 is threadably mounted to one end of the control shaft 76.

A cable pull assembly 80 is supported by a projection extending from the control pivot assembly 74. A pair of spring pins 82 are provided, one of which extends through a hole 76A in the control shaft and bears against the slotted guide 68 to provide axially restrictions on the movements of the control shaft. The other spring pin 82 secures the control pivot assembly 74 to a support shaft 84. Both the control shaft 76 and the support shaft 84 have flat-sided end portions. The flat sides of these shafts adjoin each other so that rotation of the control shaft 76 causes the support shaft 84 to rotate. Because the shaft assembly 76, 84 is comprised of two separate pieces, however, axial movement of the control shaft 76 does not result in axial movement of the support shaft 84.

A pair of rollers 86 are mounted within the bracket 66 by washers 88 and lock nuts 90. The rollers are positioned over a pair of screws 91 which are welded to the top of the bracket 66. First and second wires 92 are secured at their enlarged ends to the forked projection extending from the pull tube assembly 72. A third wire 94 is secured at its enlarged end to the forked projection of the cable pull assembly 80. This third wire extends between the rollers 86 and through an opening in the bracket 66.

The first and second wires 92 are positioned within cables 96 and are secured at ends opposite from their enlarged ends to plungers 98. Each plunger 98 is positioned within a cylindrical pipe 100 secured to each cylindrical tube 46. An L-shaped bracket 102 having a forked end is secured to each pipe 100. A coil spring 104 is mounted over an end of each respective plunger 98 and bears against one of the L-shaped brackets 102 and a shoulder defined by the plunger. Each plunger is according urged towards one of the respective plunger rods 44 within each cylindrical tube 46. Each plunger rod 44 includes an annular groove 106 which receives a portion of a plunger 98 when they are in alignment, thereby locking the plunger rod 44 in fixed position with respect to the cylindrical tube 46.

The third wire 94 is part of a cable 108 which extends from the bracket 66 to the second linkage assembly 58. One end of the third wire is attached to the plunger rod assembly 60 thereof, and specifically the actuating lever 110 thereof.

A third linkage assembly in the form of a pneumatic spring 112 is pivotably connected between the backrest assembly 20 and the seat assembly 22. As shown in FIG. 2, the bottom end of the pneumatic spring 112 is pivotably secured to a support frame 114 by a bracket assembly 116. The frame 114 is secured to the cross rails 64 of the seat frame assembly 32. The pneumatic spring is actuated by turning a handle 118 which causes it to be either maintained in a rigid state or free to expand or contract. The operation of the actuating mechanism for the pneumatic spring is described in detail in U.S. application Ser. No. 166,675 filed Mar. 11, 1988 now U.S. Pat. No. 4,858,260.

The patient transport apparatus 10 may be operated in the same manner as conventional apparatus wherein the backrest assembly 20 and the leg supporting assembly 24 are simultaneously rotated about their pivot axes until locked in a desired position. Such motion is accomplished by initially turning handle 118 so that the pneumatic spring 112 is free to expand or contract. The first linkage assembly 42 is maintained in its rigid state as the backrest frame 34 rotates with respect to the seat frame 32 while the second linkage assembly is free to expand or contract The first linkage assembly 42 accordingly causes the leg supporting frame 36 to rotate with respect to the seat frame. As the seat frame assembly 24 and the backrest assembly 20 are simultaneously rotated, they are maintained substantially parallel to each other.

As discussed above, the first linkage assembly performs as a rigid connecting rod when the spring-loaded plungers 98 engage the grooves 106 in the respective plunger rods 44. The second linkage assembly remains free to expand or contract when the apparatus is used in this manner, i.e., when the handle 78 is in the "in" position.

To permit independent operation of the backrest and leg supporting assemblies, the operator supports the leg supporting assembly and pulls the handle 78 away from the bracket 66. This causes the pull tube assembly 72 to move axially with the control shaft 76, thereby pulling the wires 92 connected to the pull tube assembly. The wires, being connected to the spring-loaded plungers 98, cause the latter to be withdrawn from the grooves 106 within the respective plunger rods 44, thereby allowing the first linkage assembly 42 to expand or contract as the leg supporting frame 36 is rotated with respect to the seat frame 32.

The handle 78 is turned clockwise by the operator at the same time or soon after it is pulled out. This causes the rotation of the support shaft 84 about its axis and corresponding rotation of the control pivot assembly 74 and cable pull assembly 80 which are attached thereto. The wire 94 secured to the cable pull assembly 80 is accordingly pulled towards the rollers 86, thereby causing the actuating lever 110 of the second linkage assembly to be pulled. This frees the plunger portion of the plunger rod assembly 60 and allows it to move axially with respect to this assembly 60. Release of the handle while in the "out" position will result in the turning thereof due to the action of the spring-loaded actuating lever 110. The leg supporting assembly 24 will accordingly be locked in position as the second linkage assembly 58 functions as a rigid rod. The handle 78 must be pushed in, however, for the plungers 98 to again engage the grooves 106 in the plunger rods 44. The first linkage assembly 42 accordingly is free to operate in a telescoping manner, even if the plungers 98 are aligned with the grooves 106. By turning the backrest handle 118, the pneumatic spring is free to expand or contract, and the backrest assembly may be positioned independently of the leg supporting assembly.

To return to simultaneous backrest/leg supporting assembly operation, the leg supporting assembly should be supported by the operator while the handle 78 is turned counterclockwise and pushed in. In this position, the lever 110 is actuated so that the second linkage assembly is not rigid. The natural tendency for the second linkage assembly 58 to assume its rigid condition is addressed when the handle 78 is turned counter clockwise and pushed in. This positions pin 82 on control shaft 76 into a retained position in the slotted guide 68, thus holding cable pull assembly 80 in a position that pulls cable 94 towards rollers 86, thereby causing the actuating lever 110 of the second linkage assembly 58 to be kept in a non-rigid condition. (Conversely, when the handle is pulled out, the cable pull assembly 80 is free to turn, thereby allowing the second linkage assembly to lock the leg supporting assembly in position ) The operator moves the leg supporting assembly until the plungers 98 are aligned with the grooves 106 in the plunger rods 44. The plungers 98 thereby lock the first linkage means 42 into a rigid position so that the leg supporting assembly rotates with the backrest assembly. Such locking takes place when the leg supporting assembly is substantially parallel to the backrest assembly.

What is claimed is:

1. A patient support apparatus comprising:

a seat assembly;

a backrest assembly pivotably secured to said seat assembly;

a leg supporting assembly pivotably secured to said seat assembly, said leg supporting assembly including an upper end and a lower end;

first and second pivot members supported by said leg supporting assembly;

first linkage means connecting said backrest assembly and said leg supporting assembly, one of said first and second pivot members being positioned nearer said upper end of said leg supporting assembly than the other of said first and second pivot members, said first linkage means including a first end portion pivotably connected to said backrest assembly and a second end portion pivotably connected to said first pivot member;

first locking means for locking said first linking means so that said first linkage means cannot extend or contract;

second linkage means connecting said seat assembly and said leg supporting assembly, said second linkage means being extensible and contractible, said second linkage means including a first end portion pivotably connected to said seat assembly and a second end portion pivotably connected to said seat assembly and a second end portion pivotably connected to said second pivot member; and second locking means or locking said second linkage means so that said second linkage means cannot extend or contract.

2. An apparatus as defined in claim 1 wherein said first locking means is in a locked position whereby said first linkage means is incapable of extension or contraction and said second locking means is in an unlocked position whereby said second linkage means is free to expand or contract.

3. An apparatus as defined in claim 1 including means for simultaneously deactuating said first locking means so that said first linkage mean is free to expand or contract and actuating said second locking means so that said second linkage means is incapable of expansion or contraction.

4. An apparatus as defined in claim 1 wherein said first linkage means includes a telescoping tube and plunger assembly.

5. An apparatus as defined in claim 4 wherein said telescoping tube and plunger assembly includes a tube and a plunger at least partially positioned within said tube.

6. An apparatus as defined in claim 5 wherein said first locking means includes a locking pin extending within said tube and engaging said plunger.

7. An apparatus as defined in claim 6 including a cable secured to said locking pin and a handle secured to said cable.

8. An apparatus as defined in claim 6 including means for resiliently urging said locking pin toward said plunger.

9. An apparatus as defined in claim 8 including a groove defined within said plunger, said locking pin being capable of fitting within at least part of said groove to lock said plunger in a fixed position with respect to said tube.

10. An apparatus as defined in claim 9 wherein one end of said telescoping tube and plunger assembly is pivotably secured to said backrest assembly and an opposite end of said telescoping tube and plunger assembly is pivotably secured near an upper end portion of said leg supporting assembly.

11. An apparatus as defined in claim 10 wherein said second pivot is secured to a lower end portion of said leg supporting assembly.

12. An apparatus as defined in claim 9 wherein said groove is defined within said plunger at a position where said locking pin engages said groove only when said backrest assembly and leg supporting assembly are oriented in substantially parallel relation to each other.

13. An apparatus as defined in claim 1 including means for pivotably connecting said first linkage means between a lower end of said backrest assembly and said upper end of said leg supporting assembly.

14. An apparatus as defined in claim 13 including means for pivotably connecting said second linkage means between said seat assembly and a relatively lower position of said leg supporting assembly from where said first linkage means is connected thereto.

15. An apparatus as defined in claim 14 including third linkage means pivotably connected between said seat assembly and said backrest assembly, said third linkage means being extensible and contractible

16. An apparatus as defined in claim 1 including a base, a column mounted to said base, said seat assembly being mounted to said column, and a plurality of wheels mounted to said base.

17. A patient transport apparatus comprising:

a base;

a plurality of wheels mounted to said base;

a chair/stretcher assembly mounted to said base, said chair/stretcher assembly including a seat assembly, a backrest assembly pivotably mounted to said seat assembly, and a leg supporting assembly, said leg supporting assembly including an upper end and a lower end pivotably mounted to said seat assembly;

first and second pivot members supported by said leg supporting assembly, one of said first and second pivot members being positioned nearer said upper end of said leg supporting assembly than the other of said first and second pivot members;

first linkage means connecting said backrest assembly and said leg supporting assembly, said first linkage means being extensible and contractible, said first linkage means including a first end portion pivotably connected to said backrest assembly and a second end portion pivotably connected to said first pivot member;

second linkage means connecting said seat assembly and said leg supporting assembly, said second linkage means being extensible and contractible, said second linkage means including a first end portion pivotably connected to said seat assembly and a second end portion pivotably connected to said second pivot member;

first locking means for locking said first linkage means so that said first linkage means cannot extend or contract; and second locking means for locking said second linkage means so that said second linkage means cannot extend or contract.

18. An apparatus as defined in claim 17 wherein said first linkage means is connected between a lower end of said backrest assembly and an upper end of said leg supporting assembly.

19. An apparatus as defined in claim 18 wherein said second linkage means is connected between said seat assembly and a relatively lower position of said leg supporting assembly from where said first linkage means is connected thereto, said second pivot member being positioned at a lower position upon said leg supporting assembly than said first pivot member.

20. An apparatus as defined in claim 17 wherein said first linkage means include a pair of telescoping tube and plunger assemblies.

21. A patient support apparatus comprising:

a seat assembly;

a backrest assembly pivotably secured to said seat assembly;

a leg supporting assembly pivotably secured to said seat assembly;

a first telescoping tube and plunger assembly pivotably connected to said backrest assembly and said leg supporting assembly;

a second telescoping tube and plunger assembly pivotably connected to said seat assembly and said leg supporting assembly;

first locking means for locking said first telescoping tube and plunger assembly such that it cannot extend or contract; and second locking means for locking said second telescoping tube and plunger assembly such that it cannot extend or contract.

* * * * *

UNITED STATES PATENT AND TRADEMARK OFFICE

CERTIFICATE OF CORRECTION

PATENT NO. : 4,945,582

DATED : August 7, 1990

INVENTOR(S) : Hayton et al.

It is certified that error appears in the above-identified patent and that said Letters Patent is hereby corrected as shown below:

Column 1, Line 3, after "obtainable" change "," to --.--

Column 4, Line 27, please insert --.-- after "contact"

Column 5, Line 24, please insert --.-- after "position"

Column 6, Line 5, after "linkage" change "mean" to --means--.

Column 6, Line 57, please insert --.-- after "contractible".

UNITED STATES PATENT AND TRADEMARK OFFICE

CERTIFICATE OF CORRECTION

PATENT NO. : 4,945,582

DATED : August 7, 1990

INVENTOR(S) : Hayton et al.

It is certified that error appears in the above-identified patent and that said Letters Patent is hereby corrected as shown below:

Please rewrite claim 1 as follows:

1. A patient support apparatus comprising:
a seat assembly;

a backrest assembly pivotably secured to said seat assembly;

a leg supporting assembly pivotably secured to said seat assembly, said leg supporting assembly including an upper end and a lower end;

first and second pivot members supported by said leg supporting assembly, one of said first and second pivot members being positioned nearer said upper end of said leg supporting assembly than the other of said first and second pivot members;

first linkage means connecting said backrest assembly and said leg supporting assembly, said first linkage means being extensible and contractible, said first linkage means including a first end portion pivotably connected to said backrest assembly and a second end portion pivotably connected to said first pivot member;

first locking means for locking said first linkage means so that said first linkage means cannot extend or contract;

second linkage means connecting said seat assembly and said leg supporting assembly, said second linkage means being extensible and contractible, said second linkage means including a first end portion pivotably connected to

UNITED STATES PATENT AND TRADEMARK OFFICE

CERTIFICATE OF CORRECTION

PATENT NO. : 4,945,582

DATED : August 7, 1990

INVENTOR(S) : Hayton et al.

It is certified that error appears in the above-identified patent and that said Letters Patent is hereby corrected as shown below:

said seat assembly and a second end portion pivotably connected to said second pivot member; and second locking means for locking said second linkage means so that said second linkage means cannot extend or contract.

Signed and Sealed this

Seventh Day of July, 1992

*Attest:*

DOUGLAS B. COMER

*Attesting Officer*

*Acting Commissioner of Patents and Trademarks*